US007347167B2

(12) United States Patent
Sugiyama et al.

(10) Patent No.: US 7,347,167 B2
(45) Date of Patent: Mar. 25, 2008

(54) METHOD FOR CONTROLLING COOLING FANS

(75) Inventors: Kazuya Sugiyama, Hiroshima (JP); Eiji Kosaka, Hiroshima (JP); Shinichi Ohshima, Hatsukaichi (JP); Tatsunori Iwasaki, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 19 days.

(21) Appl. No.: 11/351,545

(22) Filed: Feb. 10, 2006

(65) Prior Publication Data

US 2006/0191500 A1 Aug. 31, 2006

(30) Foreign Application Priority Data

Feb. 28, 2005 (JP) ..... 2005-054478

(51) Int. Cl.
*F01P 7/02* (2006.01)
*F01P 7/10* (2006.01)
*H02H 7/08* (2006.01)

(52) U.S. Cl. ..... 123/41.11; 123/41.12; 123/41.49; 318/471

(58) Field of Classification Search ..... 123/41.11, 123/41.12, 48, 41.48, 41.49; 236/35, 38; 318/471

See application file for complete search history.

(56) References Cited

U.S. PATENT DOCUMENTS 4,036,432 A * 7/1977 George ..... 236/35
4,651,922 A * 3/1987 Noba ..... 236/35
4,765,284 A * 8/1988 Kanazawa et al. ..... 123/41.49
4,977,862 A * 12/1990 Aihara et al. ..... 123/41.12
6,933,687 B2 * 8/2005 Makaran et al. ..... 318/34
2004/0066156 A1 4/2004 Makaran et al.
2004/0206099 A1 * 10/2004 Kim ..... 62/178

FOREIGN PATENT DOCUMENTS

JP 2001-193460 A 7/2001
JP 2004-044507 A 2/2004

OTHER PUBLICATIONS

European Search Report for European Patent Application No. 06003824.7 dated May 31, 2006.
English Translation of Specification and Drawings of JP2001-193460A.

* cited by examiner

*Primary Examiner*—Stephen K. Cronin
*Assistant Examiner*—Hyder Ali
(74) *Attorney, Agent, or Firm*—Alleman Hall McCoy Russell & Tuttle LLP

(57) ABSTRACT

A method for controlling a cooling system for an internal combustion engine having first and second cooling fans is provided, comprising operating the first cooling fan at a first rotational frequency which is greater than a combustion frequency of the internal combustion engine and operating the second cooling fan at a second rotational frequency which is less than the combustive vibration frequency of the internal combustion engine. Since the rotational frequencies of the first and second cooling fans are different from the combustion frequency of the internal combustion engine, the resonance between the rotational vibration of the cooling fans and the combustive vibration of the internal combustion engine may be prevented. Also, since the rotational frequencies of the first and second cooling fans are different from each other so that the resonance between their rotational vibrations may be prevented.

17 Claims, 4 Drawing Sheets

METHOD FOR CONTROLLING COOLING FANS

BACKGROUND

The present invention generally relates to a method for cooling an internal combustion engine, more particularly relates to a method for controlling cooling fans for an internal combustion engine on a vehicle.

A method to operate cooling fans is presented in Japanese Patent Application Publication no. H11-107753. In particular, the method describes differentiating a combustive vibration frequency of the engine which is a $n^{th}$ order frequency component of the engine rotation (e.g. a second order component (second order vibration) in a case of four cylinder four stroke engine) and a rotational vibration frequency of cooling fans from each other by lowering rotational speed of the two cooling fans when the engine coolant temperature is lower and while the engine is idling.

The inventors herein have recognized disadvantages of the above-mentioned method. Namely, lowering the fan speeds may lead to lower the cooling air flow and thereby reduce the cooling capacity of the radiator and/or condenser. And although it may be possible to improve the cooling system capacity by increasing the fan diameter and the electric motor output, increasing the fan inertia can also increase the amplitude of the rotational fluctuation of the fan. Furthermore, resonance between the two cooling fans operating at the same rotational frequencies can become a problem as a new source of vibration and/or noise during engine idle where such noise may be undesirable.

SUMMARY

Accordingly, in one aspect of the present description, there is provided a method for controlling a cooling system for an internal combustion engine having first and second cooling fans, comprising operating the first cooling fan at a first rotational frequency which is different than a combustion frequency of said internal combustion engine, and operating the second cooling fan at a second rotational frequency which is different than said first rotational frequency and said combustion frequency. By operating the first and second cooling fans at the rotational frequencies different from each other and the combustion frequency, the undesirable summing of vibration and/or noise that may be present in the engine and/or fans is avoided.

In another aspect of the present description, by setting the rotational frequency of the first cooling fan above the combustion frequency of the engine and by setting the rotational frequency of the second cooling fan below the combustion frequency of the engine, for example, the undesirable summing of frequencies that may be present in the engine and/or fans is prevented, and further, the overall cooling capacity of the cooling system may be maintained.

Accordingly, since the rotational frequencies of the first and second cooling fans are different from the combustive vibration frequency of the internal combustion engine, the summing of the frequencies or resonance between the rotational vibration of the cooling fans and the combustive vibration of the internal combustion engine may be prevented. Also, since the rotational frequencies of the first and second cooling fans are different from each other, the resonance between their rotational vibrations may be prevented, so as to prevent the undesirable vibration and/or noise which may be caused by the engine and the cooling fans. Further, since the rotational speed of the first cooling fan may be increased while the rotational speed of the second cooling fan may be decreased, the total airflow may be maintained so as to provide enough cooling air to the heat exchanger while preventing the undesirable vibration and/or noise as described above.

BRIEF DESCRIPTION OF THE DRAWINGS

The advantages described herein will be more fully understood by reading an example of an embodiment in which the invention is used to advantage, referred to herein as the Detailed Description, with reference to the drawings wherein.

DETAILED DESCRIPTION

Figure 1:
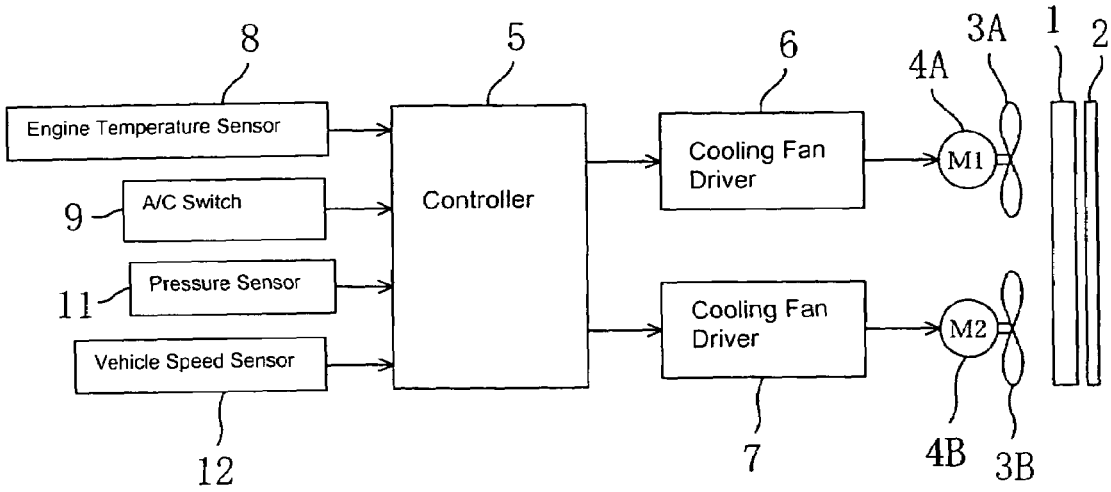
FIG. 1 is a schematic representation of the cooling system in accordance with an embodiment of the present invention.

In FIG. 1 there is shown a schematic representation of a cooling system for an internal combustion engine (not shown) on a vehicle such as an automotive vehicle (not shown), which has a radiator 1 cooling the engine coolant by exchanging heat between the engine coolant and airflow through it (heat exchanger for engine coolant) and a condenser 2 consisting a part of refrigeration circuit for an air conditioner for a vehicle compartment which cools and condense the air conditioner coolant by exchanging heat between the air conditioner coolant and the airflow through it (heat exchanger for air conditioner coolant). The radiator 1 and the condenser 2 are arranged in an engine compartment of the vehicle where they can get the airflow from an air inlet of the vehicle, such as a front air inlet in a front grill or a front bumper, so that more air flows through them during the vehicle moving. There are also provided a first cooling fan 3A and a second cooling fan 3B so that the radiator 1 and the condenser 2 also receive airflow blown by the cooling fans 3A and 3B. Blow capacities of the first and second cooling fans, such as fan diameters or numbers of fan blades, may or may not be the same as each other.

The cooling fans 3A and 3B are respectively driven by first and second electric motors 4A and 4B. There are provided first and second cooling fan driver circuits 6 and 7, such as power transistors, regulating electric power supplied to the electric motors 4A and 4B. A controller 5 is microcomputer based and outputs pulse signals to the driver circuits 6 and 7 to control the electric motors 4A and 4B in the pulse width modulated (PWM) fashion. In the driver circuits 6 and 7, the pulse signals are amplified and supplied to the electric motors 4A and 4B for the first and second cooling fans 3A and 3B. For the control of the cooling fans 3A and 3B, signals of an engine temperature sensor 8 detecting temperature of engine coolant, an A/C switch 9 to be turned on when the air conditioner is in operation, a pressure sensor 11 detecting pressure of air conditioner coolant in the condenser 2, a vehicle speed sensor 12 detecting speed of the vehicle, and others are input to the controller 5.

The controller 5 has an engine temperature control block, an air conditioner control block, a comparison block and an output block, while they may be physically separate blocks, or physically integral but virtually separate blocks or in other words separate steps of a computer program executed by a single computer. The engine temperature control block sets a first duty ratio D1 of the pulse signals for the electric motors 4A and 4B based on the engine temperature from the sensor 8. The air conditioner control block sets a second duty ratio D2 of the pulse signals for the electric motors 4A and 4B based on the pressure of the air conditioner coolant from the pressure sensor 11 as well as the vehicle speed from the vehicle speed sensor 12. The comparison block compares the first duty ratio D1 set at the engine temperature control block and the second duty ratio D2 set at the air conditioner control block, and when there is a difference between the first and second duty ratios D1 and D2, selects a larger one of the duty ratios as a duty ratio D to control the electric motors 4A and 4B. The output block generates and outputs pulse signals with the selected duty ratio D.

Rotational speeds of the cooling fans 3A and 3B, which is equal or proportional to speeds of the electric motors 4A and 4B, correspond to the duty ratio D, so setting the duty ratio D means setting the fan rotational speed.

Figure 2:
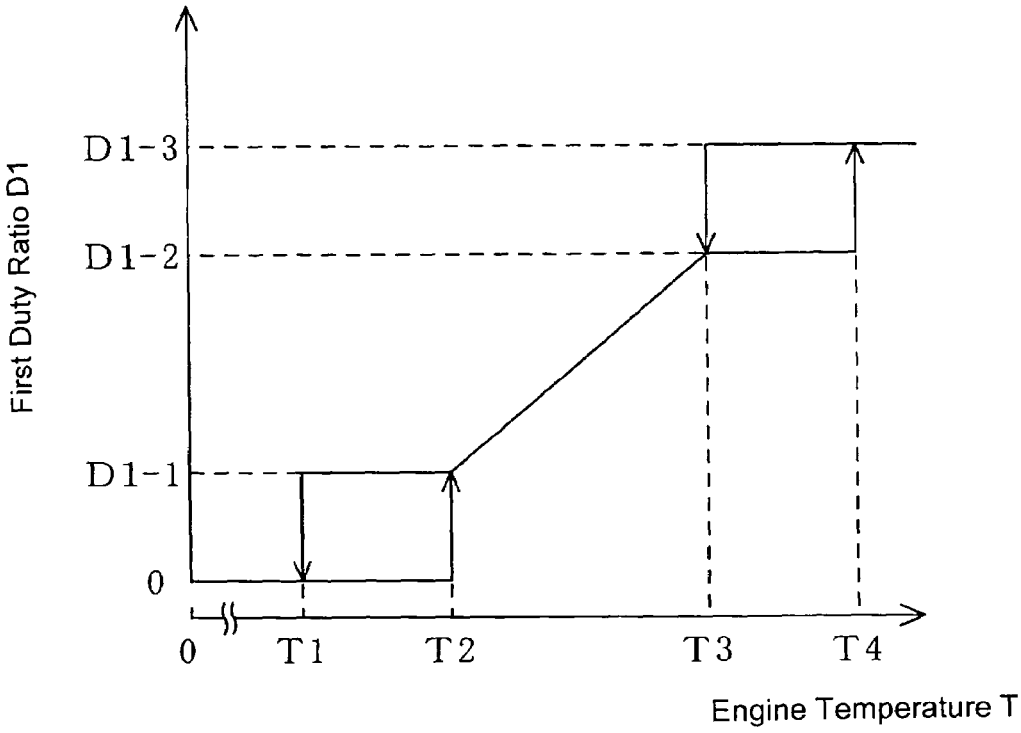
FIG. 2 is a graph depicting a relationship between the engine temperature and the duty ratio driving the cooling fans.

More specifically describing the setting of the fan speed, at first the engine temperature control block determines a duty ratio D1 which is common between the first and second electric motors 4A and 4B. As shown in FIG. 2, the duty ratio D1 is determined basically to increase as the engine temperature is higher, although at the lower temperature side it is step-changed between a value D1-1 and zero with a hysteresis between engine temperatures T1 and T2 while at the higher temperature side it is also step-changed between values D1-2 and D1-3 with a hysteresis between engine temperatures T3 and T4.

Figure 3:
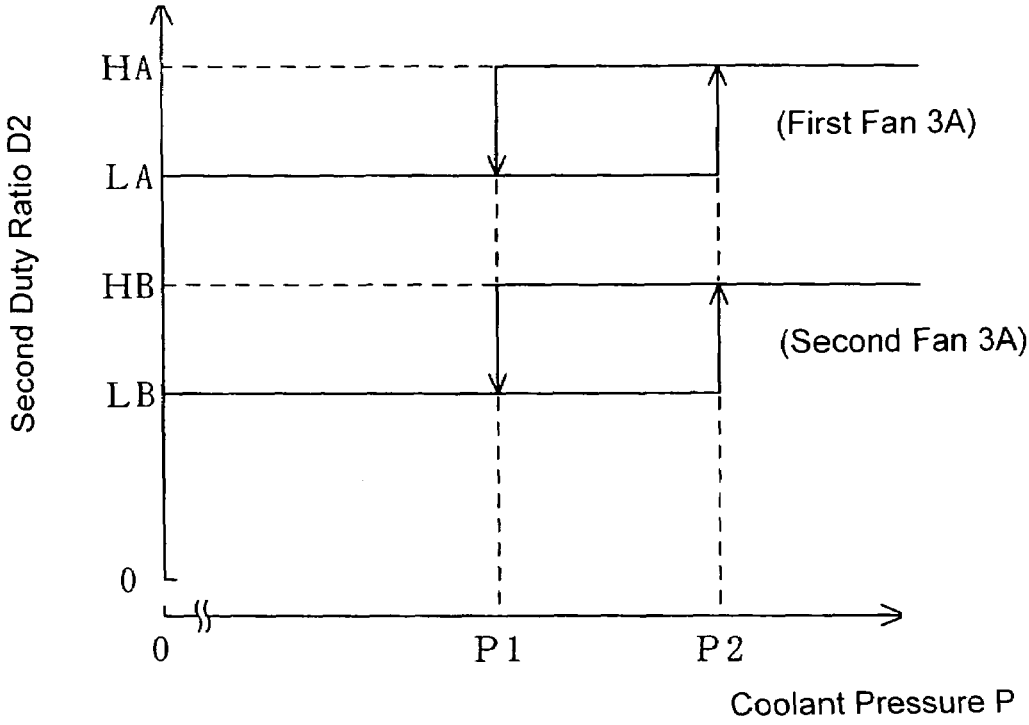
FIG. 3 is a graph depicting a relationship between the air conditioner coolant pressure and the duty ratio for the cooling fans.

The air conditioner control block determines the duty ratios D2 separately for the first and second electric motors 4A and 4B, so that basically the duty ratio D2 for the first electric motor 4A is higher, the duty ratio D2 for the second electric motor 4B is lower and the duty ratios D2 increases as the coolant pressure higher. As shown in FIG. 3, the duty ratio D2 for the first electric motor 4A is determined with a hysteresis between coolant pressures P1 and P2 so as to be equal to a value HA when the coolant pressure P has increased to be the P1 and be equal to a value LA when the coolant pressure P has decreased to be the P2, where the HA is larger than the LA. The duty ratio D2 for the second electric motor 4A is also determined with a hysteresis between the coolant pressures P1 and P2 so as to be equal to a value HB when the coolant pressure P has increased to be the P1 and be equal to a value LB when the coolant pressure P has decreased to be the P2, where the HB is larger than the LB and the HA is larger than the HB.

The high duty ratios HA and HB for the first and second electric motors 4A and 4B are substantially constant values and determined so as to make the speeds of the first and second cooling fans 3A and 3B not to resonate with the $n^{th}$ order vibration or the combustive vibration of the internal combustion engine during its idling. Here a frequency $F_R$ of the rotational frequency of the cooling fan and a frequency $F_C$ of the combustive vibration of a four stroke engine are determined as the following formulas:

$$F_R(\text{Hz})=(\text{Fan speed (rpm)})/60$$

$$F_C(\text{Hz})=(\text{Engine speed (rpm)})\times(\text{Number of cylinders})/(60\times 2)$$

The high duty ratio HA for the first electric motor 4A may be determined so that rotational vibration frequency (number of fan rotations per unit of time) $F_{R1}$ of the first cooling fan 3A is different or higher than the combustive vibration frequency (number of combustions per unit of time) $F_C$ in the engine idling, such as 23 Hz in a case of 700 rpm idling speed of four cylinder four stroke engine, by at least a predetermined value, for example several Hertz, which would come up with such as a rotational frequency of 30 Hz or a fan rotational speed of 1800 rpm in the case of 700 rpm engine idling speed. Also, the high duty ratio HB for the second electric motor 4B may be determined so that the rotational vibration frequency $F_{R2}$ of the cooling fan 3B is different or lower than the combustive vibration frequency $F_C$ during the engine idling by a predetermined value, for example several Hertz, which would come up with such a rotational vibration frequency of 16 Hz or a fan rotational speed of 960 rpm in the above case of 700 rpm engine idling speed.

On the other hand, the low duty ratios LA and LB of the first and second electric motors 4A and 4B may be determined based on the vehicle speed V. That is, as a vehicle speed correction of the first cooling fan 3A shown in FIG. 4, the low duty ratio LA is set basically smaller as the vehicle speed V is higher. It should be noted that in this embodiment, the low duty ratio LA is set in three steps depending on the vehicle speed V, and at the lower vehicle speed side it is step-changed between values LA-1 and LA-2 with a hysteresis between vehicle speeds V1 and V2 and also at the higher vehicle speed side it is step-changed between the value LA-1 and zero with a hysteresis between vehicle speeds V3 and V4. Note that the high duty ratio HA is given as the low duty ratio LA-2 at the lower vehicle speed side.

Figure 5:
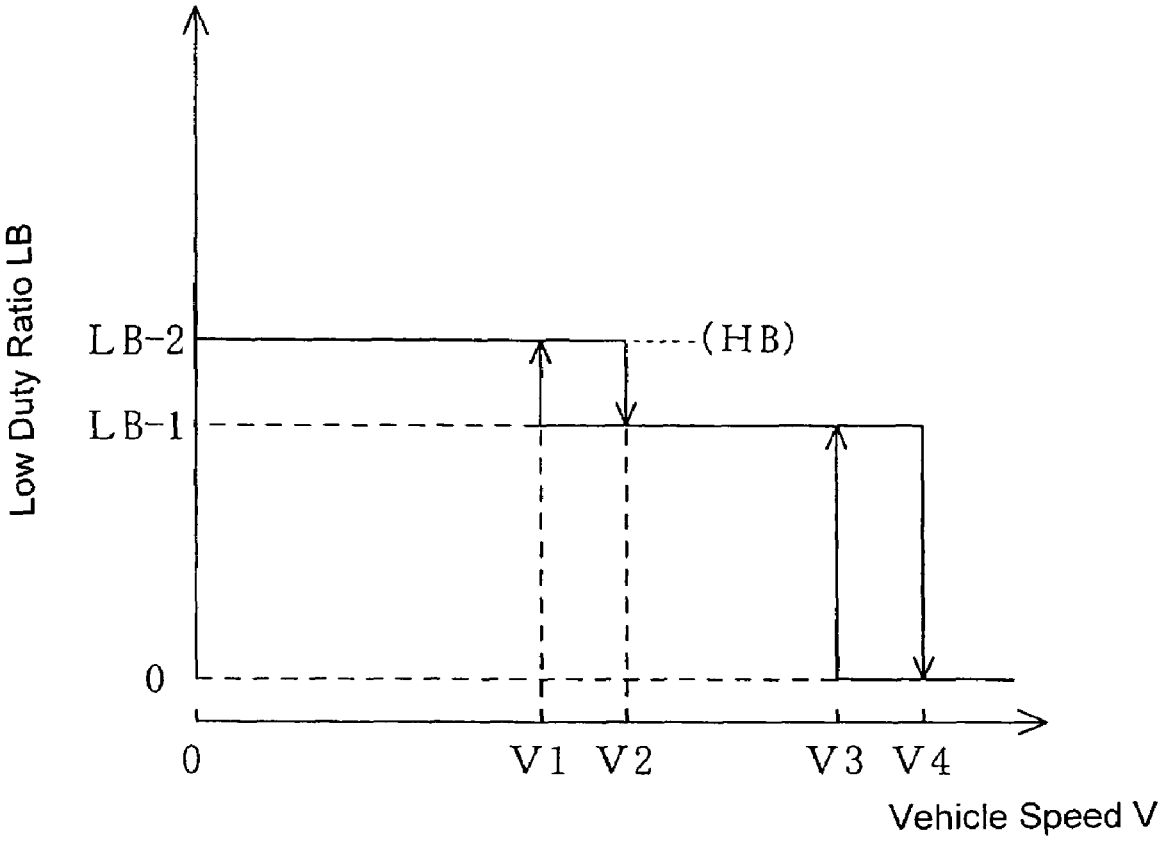
FIG. 5 is a graph depicting a relationship between the vehicle speed and the duty ratio for the second cooling fan.

Vehicle speed correction of the low duty ratio LB is shown in FIG. 5. Also in this case, the low duty ratio LB is set basically smaller as the vehicle speed is higher, further, the low duty ratio LB is set in three steps depending on the vehicle speed V, at the lower vehicle speed side it is step-changed between values LB-1 and LB-2 with a hysteresis between vehicle speeds V1 and V2 and at the higher vehicle speed side it is step-changed between the value LB-1 and zero with a hysteresis between vehicle speeds V3 and V4. Note that the high duty ratio HB is given as the low duty ratio LB-2 at the lower vehicle speed side.

Figure 6:
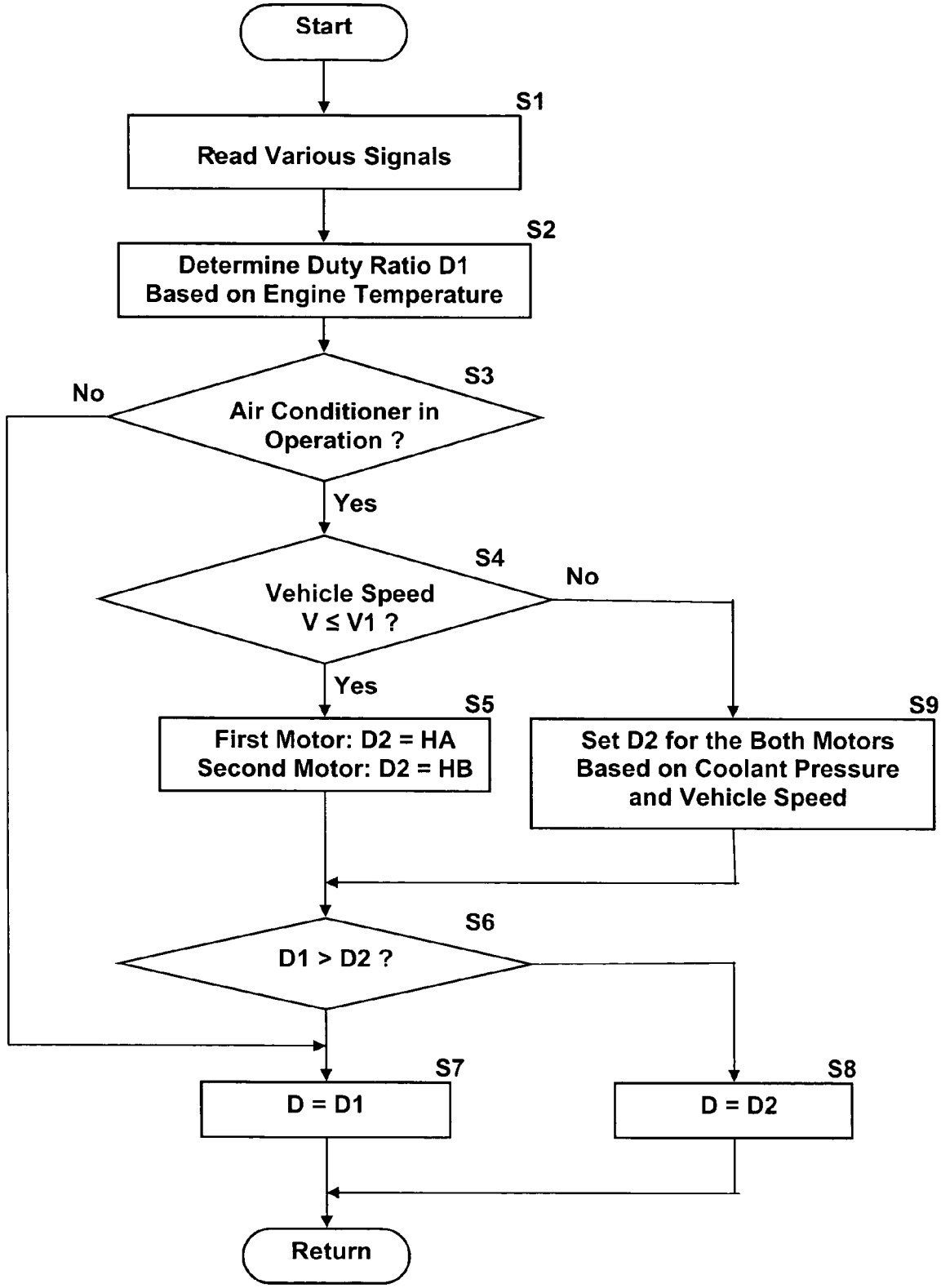
FIG. 6 is a flowchart showing setting control for the duty ratios driving the cooling fans.

FIG. 6 shows a flowchart of a control routine for the electric motors 4A and 4B for the cooling fans 3A and 3B. At a step S1 after the start of the routine, signals of the engine temperature sensor 8, the A/C switch 9, the pressure sensor 11, the vehicle speed sensor 12 and others are read, and at a following step S2 the common duty ratio D1 for the electric motors 4A and 4B is determined based on the engine temperature as described above with reference to FIG. 2. Then the routine proceeds to a step S3 where it is determined whether the air conditioner is in operation or not by determining a state of the A/C switch 9, the coolant pressure P detected by the pressure sensor 11 or any other appropriate means to detect the operating state of the air conditioner, such as detecting signals from an engine control unit. If the air conditioner is not in operation, the routine proceeds to a step S7 where the first duty ratio D1 is given as the control duty ratio D for both of the electric motors 4A and 4B, then the cooling fans 3A and 3B are controlled only with the engine temperature.

Figure 4:
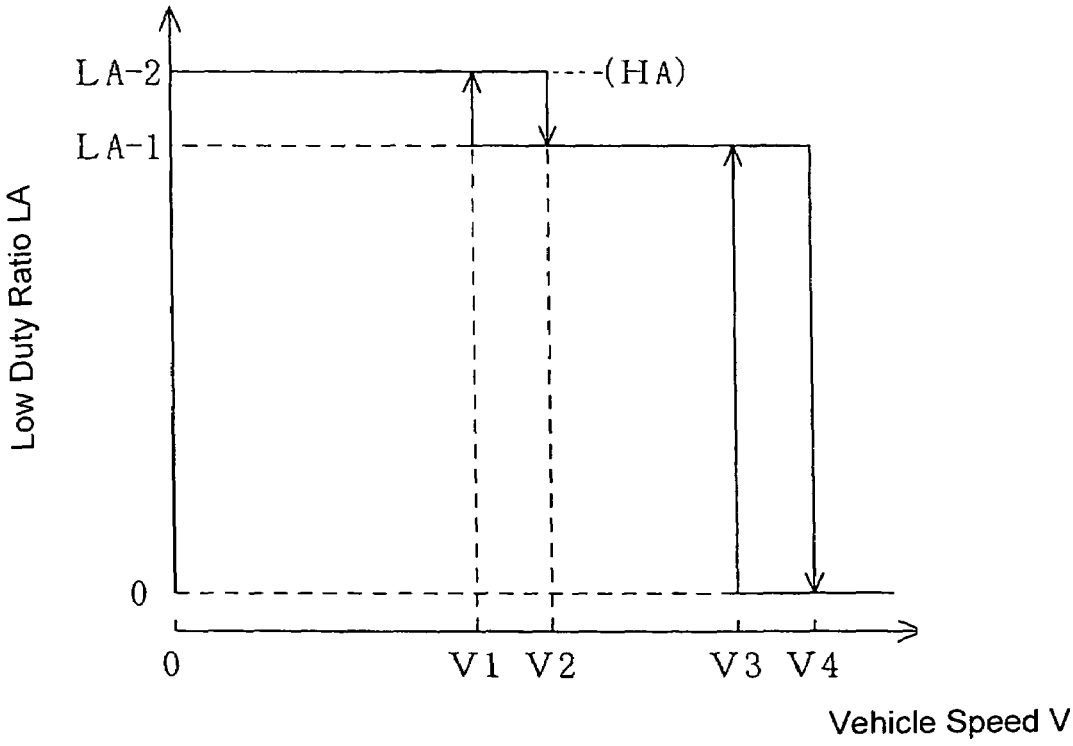
FIG. 4 is a graph depicting a relationship between the vehicle speed and the duty ratio for the first cooling fan.

If it is determined in the step S3 that the air conditioner is in operation, the routine proceeds to a step S4 where it is determined whether the vehicle speed is a predetermined vehicle speed V1 or less. This predetermined vehicle speed V1 is the same value as the V1 in the vehicle speed corrections shown in FIGS. 4 and 5, although it may be set different values. When the vehicle speed V is determined to be lower than the predetermined vehicle speed V1 at the step S4, the routine proceeds to a step S5 where the high duty ratios HA and HB are given as the second duty ratios D2 for the respective electric motors 4A and 4B. That is, when the vehicle speed V is lower than the predetermined vehicle speed V1, the low duty ratios LA and LB for the second duty ratios D2 for the electric motors 4A and 4B are set the values LA-2 and LB-2, or in other words the high duty ratios HA and HB as shown in FIGS. 4 and 5.

Then the routine proceeds to a step S6 where it is determined whether the first duty ratio D1 is greater than the second duty ratio D2 for the first electric motor 4A. If the first duty ratio D1 is larger than the second duty ratio D2 for the first electric motor 4A, it proceeds to a step S7 where the first duty ratio D1 is adopted as the control duty ratio D for the both first and second electric motors 4A and 4B. In this case, the both first and second electric motors are driven at the rotational frequency higher than the engine combustive frequency so that the resonance between the rotational vibration of the cooling fans 3A and 3B and the combustive vibration of the engine can be prevented, although the control duty ratio D only for the first electric motor 4A may be set to be the first duty ratio D1 and for the second electric motor may be set a duty ratio other than the D1 such as the second duty ratio D2 for the second motor 4B so that the resonance between the fan rotational vibration and the engine combustive vibration as well as the resonance between the fan rotational vibrations with each other can be prevented.

If the second duty ratio D2 for the first electric motor 4A is determined greater than the first duty ratio D1 at the step S6, the routine proceeds to a step S8 where the second duty ratios D2 for the respective first and second electric motors 4A and 4B are adopted as the respective control duty ratios D.

If at the vehicle speed V is determined to be higher than the predetermined vehicle speed V1 at the step S4, the routine proceeds to a step S9 where the second control ratios D2 for the respective electric fans 3A and 3B are determined based on the coolant pressure P detected by the pressure sensor 11 and the vehicle speed V detected by the vehicle speed sensor 12 as described above with reference to FIGS. 3 through 5, then proceeds to the step S6.

As described above, when the air conditioner is in operation, if the vehicle speed V is lower than the predetermined vehicle speed V1, the respective duty ratios D2 of the first and second electric motors 4A and 4B are set the high duty ratios HA and HB. With this setting, since the cooling fan 3A has its rotational vibration frequency $F_{R1}$ be higher than the engine combustive vibration frequency $F_C$ by at least a predetermined value such as 7 Hz during the engine idling, even if thereafter the engine is at the idling condition, its resonance with the engine combustive vibration is prevented. Also with respect to the cooling fan 3B, it has its rotational vibration frequency $F_{R2}$ be lower than the combustive vibration frequency $F_C$ by at least a predetermined value during the engine idling, even if thereafter the engine is at the idling condition, its resonance with the engine combustive vibration can be prevented.

Also, the situation where the rotational vibration frequency $F_{R1}$ of the first cooling fan 3A is higher by the at least predetermined value than the combustive vibration frequency $F_C$ during the engine idling and the rotational vibration frequency $F_{R2}$ of second cooling fan 3B is lower by the at least predetermined value than the combustive vibration frequency $F_C$ during the engine idling can be considered that the resonance with each other between the first and second cooling fans 3A and 3B does not occur as well. Further, it can be considered that total airflow rate by the both cooling fans 3A and 3B is not substantially different from a case where fan rotational speeds of the both cooling fans 3A and 3B are same (a case of the resonance with the engine vibration).

As such, according to the present invention, without reduction of cooling capacity of the radiator 1 and the condenser 2 by the cooling fans 3A and 3B, the resonance of the cooling fans 3A and 3B with the engine vibration as well as the resonance between the fans with each other can be prevented so that the quietness during the engine idling when the driving noise from the own vehicle is zero can be achieved without obstructing the engine cooling or the air conditioning for the vehicle compartment.

However, even when during the air conditioner operation the vehicle speed V is lower than the predetermined vehicle speed V1 and the high duty ratios HA and HB are adopted as the second duty ratios D2 for the cooling fans 3A and 3B, if the first duty ratio D1 determined from the engine cooling requirement is higher, the cooling fans 3A and 3B are controlled with the first duty ratio D1 so that the engine cooling is not obstructed.

Further, although in the above embodiment, the second duty ratios D2 for the first and second cooling fans 3A and 3B are set so as to prevent the resonance with the fan rotational vibration and the engine combustive vibration during the engine idling, the high duty ratios HA and HB for the cooling fans 3A and 3B may be set so as to prevent the resonance between the fan rotational vibration and the engine combustive vibration in a broader range of engine rotational speed including an engine rotational speed during idling.

Also, although, in the above embodiment, the second duty ratios D2 for the first and second cooling fans 3A and 3B are set the high duty ratios HA and HB when the vehicle speed V is lower than the predetermined vehicle speed V1 considering a transition of the vehicle to a vehicle stop idling state, the second duty ratios D2 for the cooling fans 3A and 3B may be set the high duty ratio HA and HB when the engine rotational speed falls to a predetermined value or less or when the engine falls in the vehicle stop idling state.

In summary, there are provided in the present description the method for controlling a cooling system for an internal combustion engine having first and second cooling fans 3A and 3B, comprising operating the first cooling fan 3A at a first rotational frequency $F_{R1}$ which is different than a combustion frequency $F_C$ of the internal combustion engine, and operating the second cooling fan 3B at a second rotational frequency $F_{R2}$ which is different than the first rotational frequency $F_{R1}$ and the combustion frequency $F_C$, a cooling system for the internal combustion engine comprising the heat exchanger, for example a radiator 1 and a condenser 2 for an air conditioner, the first cooling fan 3A, the second cooling fan 3B and a controller which implement the above method, and a computer readable storage medium having stored data representing instructions to implement the above method, which may be implemented within the controller 5. The first and second rotational frequencies $F_{R1}$ and $F_{R2}$ may be substantially constant because the high duty ratios HA and HB for the first and second motors 4A and 4B may be set substantially constant as described above, so as to consistently preventing the summing of undesirable frequencies that may be present in the engine and/or fans. Further the first rotational frequency $F_{R1}$ may be greater than the combustion frequency $F_C$ and the second rotation frequency may be less than the combustion frequency $F_C$ as described above, so as to provide sufficient cooling while preventing the resonance of vibrations of the two cooling fans. The method may further comprise determining temperature of the internal combustion engine, for example with the engine temperature sensor 8, setting a third rotational frequency $F_{R3}$ of the first cooling fan 3A based on the determined temperature of the internal combustion engine for example setting the duty ratio D1 at the step S3 in FIG. 6, and when the third rotational frequency $FR_3$ is greater than the first rotational frequency $F_{R1}$, operating the first cooling fan 3A at the third rotational frequency $F_{R3}$, where the requirement of reducing the temperature of the internal combustion engine overcomes the need for lower noise from the cooling fans, so as to ensure the reliable engine operation. Further in this respect, the second cooling fan may also be operated at a rotational frequency which is higher than the combustive vibration frequency of the internal combustion engine.

There is also provided in the present description a method for controlling a cooling system for an internal combustion engine having first and second cooling fans 3A and 3B, the method comprising a first mode wherein the first cooling fan 3A is operated at a first rotational frequency $F_{R1}$ which is different than a combustion frequency $F_C$ of the internal combustion engine and the second cooling fan 3B is operated at a second rotational frequency $F_{R2}$ which is different than the first rotational frequency $F_{R1}$ and the combustion frequency $F_C$, and a second mode wherein the rotational frequencies of the first and second cooling fans vary as an operating condition varies, for example, by setting the duty ratio D2 based on the coolant pressure P and/or the vehicle speed V at the step S9 and or the engine temperature at the step S3 when determined the vehicle speed V is greater than the predetermined vehicle speed V1 at the step S4 in FIG. 6. Accordingly, the method may advantageously reduce the vibration and/or noise caused by the cooling fan and the internal combustion engine while effectively meeting other requirement for the cooling system, since occupants in the vehicle are more likely to feel vibration and/or noise from the vehicle as the vehicle speed lower because of lower driving noise. In this respect, engine rotational speed below a predetermined value or engine idling condition may be used instead of the vehicle speed.

In this instance, the above method may set the first mode when the air conditioner is in operation and the vehicle speed is below the first predetermined speed, such as at the steps S3 through S5 in FIG. 6. Accordingly the method may advantageously achieve more efficient energy management by conforming to the cooling requirement of the heat exchanger or coolant of the air conditioner. Further in the second mode where the vehicle speed is above the predetermined speed V4 and the coolant pressure P is below a predetermined value P1, if temperature of the internal combustion engine T is below a predetermined temperature T1, the first and second cooling fans 3A and 3B may be stopped, because of less need for the cooling air to the heat exchanger for the engine or the air conditioner, in the above description, which are the radiator 1 and the condenser 2.

It is needless to say that this invention is not limited to the illustrated embodiment and that various improvements and alternative designs are possible without departing from the substance of this invention as claimed in the attached claims.

The invention claimed is:

1. A method for controlling a cooling system for an internal combustion engine having first and second cooling fans, comprising:

stopping both of said first and second cooling fans when an engine operating condition becomes a predetermined condition;

operating said first cooling fan at a first rotational frequency which is greater than a combustion frequency of said internal combustion engine when said engine operating condition does not become said predetermined condition; and operating said second cooling fan at a second rotational frequency which is less than said combustion frequency when said engine operating condition does not become said predetermined condition.

2. The method as described in claim 1 wherein said first and second rotational frequencies are substantially constant.

3. The method as described in claim 1, further comprising:

determining temperature of said internal combustion engine; setting a third rotational frequency of said first cooling fan based on said determined temperature of said internal combustion engine; and when said third rotational frequency is greater than said first rotational frequency, operating said first cooling fan at said third rotational frequency.

4. The method as described in claim 3, further comprising:

when the third rotational frequency is higher than the first rotational frequency, controlling said second cooling Ian based on the determined engine temperature so that the second cooling fan operates at a rotational frequency above said combustion frequency.

5. A method for controlling a cooling system for an internal combustion engine having first and second cooling fans, the method comprising:

a first mode wherein said first cooling fan is operated at a first rotational frequency which is greater than a combustion frequency of said internal combustion engine and said second cooling fan is operated at a second rotational frequency which is less than said combustion frequency;

a second mode wherein the rotational frequencies of said first and second cooling fans vary as an operating condition varies; and a third mode wherein both of the first and second fans are stopped.

6. The method as described in claim 5, further comprising:

determining speed of a vehicle loaded with said internal combustion engine;

when the determined vehicle speed is below a predetermined speed, operating said first and second cooling fans in said first mode; and when the determined vehicle speed is above said predetermined speed, operating said first and second cooling fans in said second mode.

7. The method as described in claim 5 wherein said operating condition comprises speed of a vehicle loaded with said internal combustion engine.

8. The method as described in claim 5 wherein said operating condition comprises an operating state of an air conditioner for said vehicle.

9. The method as described in claim 5 wherein said operating condition comprises temperature of said internal combustion engine.

10. The method as described in claim 5, further comprising:

determining speed of a vehicle loaded with said internal combustion engine;

determining whether an air conditioner for said vehicle is in operation; and when said air condition is determined in operation and the determined vehicle speed is below a first predetermined speed, operating said first and second cooling fans in said first mode.

11. The method as described in claim 10, further comprising:

determining temperature of said internal combustion engine;

determining a coolant pressure of said air conditioner; and when the determined vehicle speed is higher than a second predetermined speed which is higher than said first predetermined speed, the determined coolant pressure is below a predetermined value and said determined engine coolant temperature is below a predetermined temperature, stopping the operation of said first and second cooling fans in said second mode.

12. A cooling system for an internal combustion engine, comprising:

a heat exchanger;

a first cooling fan which provides cooling air to said heat exchanger;

a second cooling fan which provides cooling air to said heat exchanger; and a controller which stops both of said first and second cooling fans when an engine operating condition becomes a predetermined condition and operates said first cooling fan at a first rotational frequency which is greater than a combustion frequency of said internal combustion engine when said engine operating condition does not become said predetermined condition and operates said second cooling fan at a second rotational frequency which is less than said combustion frequency when said engine operating condition does not become said predetermined condition.

13. The cooling system as described in claim 12 wherein said heat exchanger comprises a radiator for said internal combustion engine.

14. The cooling system as described in claim 13 wherein said heat exchanger further comprises a condenser for an air conditioner of a vehicle loaded with said internal combustion engine.

15. The cooling system as described in claim 12 wherein said first and second rotational frequencies are substantially constant.

16. A computer readable storage medium having stored data representing instructions executable by a computer to control a cooling system for an internal combustion engine having first and second cooling fans, said storage medium comprising the instructions to:

stop both of said first and second fans when an engine operating condition becomes a predetermined condition;

operate said first cooling fan at a first rotational frequency which is greater than a combustion frequency of said internal combustion engine when said engine operating condition does not become said predetermined condition; and operate said second cooling fan at a second rotational frequency which is less than said combustion frequency when said engine operating condition does not become said predetermined condition.

17. The computer readable storage medium as described in claim 16 wherein said first and second rotational frequencies are substantially constant.

* * * * *